US007753286B2

(12) United States Patent
Haiun

(10) Patent No.: US 7,753,286 B2
(45) Date of Patent: Jul. 13, 2010

(54) SPRAY NOZZLE FOR OVERHEATED LIQUID

(75) Inventor: Joseph Haiun, Boulogne (FR)

(73) Assignee: Thermokin, Boulogne (FR)

( * ) Notice: Subject to any disclaimer, the term of this patent is extended or adjusted under 35 U.S.C. 154(b) by 676 days.

(21) Appl. No.: 10/551,297

(22) PCT Filed: Mar. 12, 2004

(86) PCT No.: PCT/FR2004/000604

§ 371 (c)(1),
(2), (4) Date: Mar. 8, 2007

(87) PCT Pub. No.: WO2004/085073

PCT Pub. Date: Oct. 7, 2004

(65) Prior Publication Data

US 2007/0176022 A1 Aug. 2, 2007

(30) Foreign Application Priority Data

Mar. 24, 2003 (FR) ..... 03 03532

(51) Int. Cl.
*B05B 1/24* (2006.01)

(52) U.S. Cl. ..... 239/135; 239/589

(58) Field of Classification Search ..... 239/128, 239/133–136, 589, 592–595
See application file for complete search history.

(56) References Cited

U.S. PATENT DOCUMENTS

| | | | | |
|---|---|---|---|---|
| 2,636,780 | A * | 4/1953 | Barnes | 239/417 |
| 3,674,700 | A * | 7/1972 | Gaiser | 510/298 |
| 4,717,075 | A | 1/1988 | Carter et al. | |
| 5,881,958 | A * | 3/1999 | Asakawa et al. | 239/589 |
| 6,170,759 | B1 | 1/2001 | Meyer | |
| 6,502,767 | B2 * | 1/2003 | Kay et al. | 239/433 |

FOREIGN PATENT DOCUMENTS

| | | |
|---|---|---|
| DE | 197 11 405 A1 | 9/1998 |
| EP | 0 476 705 A2 | 3/1992 |
| WO | WO 2004/085073 A2 | 9/2004 |

* cited by examiner

*Primary Examiner*—Davis Hwu
(74) *Attorney, Agent, or Firm*—Patterson, Thuente, Skaar & Christensen, P.A.

(57) ABSTRACT

A device providing for an overheated liquid to be sprayed in very fine droplets at a very high speed, comprised of a nozzle body followed by a mixer head and several injectors opening onto a divergent speed attainment nozzle. Fittings adjust the exit section of the nozzle by adding a profiled core that may slide on the axis of the divergent nozzle and enabling, depending on its position, the exit section of the nozzle to be adjusted to maintain a maximum ejection speed of sprayed droplets. The device is particularly applicable to the chemical and energy industries.

16 Claims, 6 Drawing Sheets

Section AA

Section AA

Section BB

SPRAY NOZZLE FOR OVERHEATED LIQUID

TECHNICAL FIELD

The present invention relates to a nozzle designed to spray an Overheated Liquid in very fine droplets whose average dimension may be less than 5 microns, at a very high speed that may largely exceed the speed of sound, for flows of liquid that may be very significant and adjustable in a very wide range, these results being obtained without the assistance of compressed gas or ultrasound. The term Overheated Liquid refers to a liquid at a temperature To and a pressure Po that is greater than the saturated vapor pressure Ps corresponding to To, the vapor pressure Ps itself being greater than the pressure of the gaseous medium in which the liquid is sprayed.

The invention also relates to fittings designed to adjust the exit section of the nozzle in order to maintain a maximum supersonic speed of sprayed droplets when the pressure or temperature of the sprayed liquid varies, or when the pressure of the ambient medium in which the liquid is sprayed varies.

This device finds its application in industrial facilities necessitating the very rapid cooling of a gas by liquid spraying, and therefore involving the formation of very fine droplets of liquid at a very high speed.

BACKGROUND ART

It is known to design spray nozzles to spray unheated liquids by forming a liquid jet that is broken upon leaving the nozzle by spiraling elements or by other elements. In contrast, the device disclosed herein does not necessitate the use of such elements, and the jet explodes on its own under the effect of the overpressure of liquid.

In addition, conventional nozzles allow liquid to be sprayed at speeds that rarely exceed the speed of sound, and the average size of the sprayed droplets is rarely less than twenty or fifty microns; the best performances in terms of droplet size and speed are obtained by using compressed gas to assist the spraying, or by ultrasound for low flow nozzles; lastly, these nozzles are not equipped with devices designed to adjust the exit section to maintain a maximum supersonic speed of droplets when the pressure or the temperature of the sprayed liquid varies, or when the pressure of the ambient medium in which the liquid is sprayed varies.

SUMMARY OF THE INVENTION

The device according to the invention allows these disadvantages to be remedied in the particular cases where significant liquid flows must be sprayed in the form of very fine droplets at very high speeds, where the flows, pressure and temperatures of the sprayed liquid may vary in high proportions, and when the pressure of the medium where the liquid is sprayed may also vary in high proportions.

Therefore, the object of the present invention is a device according to the provisions described below.

The invention also relates to the characteristic points and forms of embodiments described in variations.

Version 1

Figure 1A:
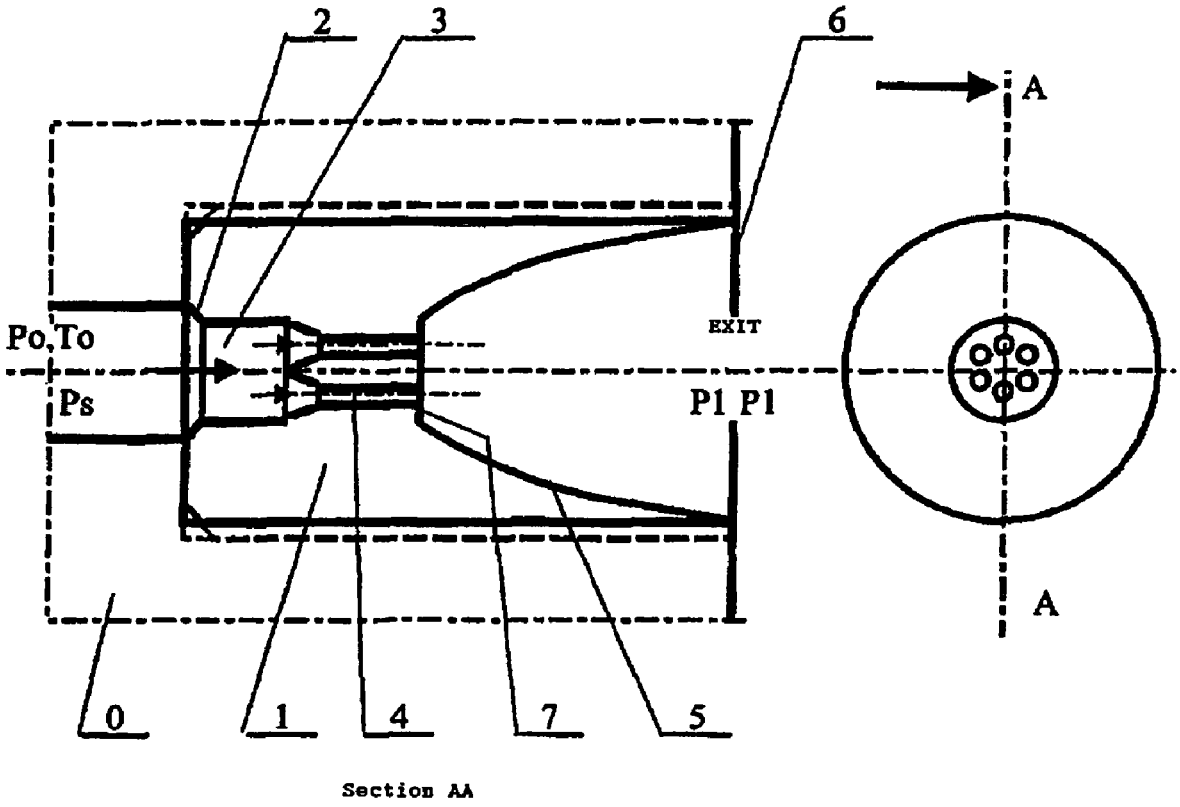
FIGS. 1*a* and 1*b* are side elevational, grossly schematic views of a nozzle body in accordance with the invention.

The device represented in FIG. 1A, comprised of a nozzle body (1) fixed on a support (0) allows the supply of Overheated Liquid; the nozzle body comprises a conduit (3) where the overheated liquid circulates, followed by a mixer head and several injectors where the overheated liquid attains speed to open onto a divergent expansion and speed attainment nozzle (5); once it has entered into this nozzle, the liquid jet partially evaporates and instantaneously explodes under the effect of its own vapor pressure to comprise a mixture of fine droplets and vapor.

The generator of the divergent nozzle (5) presents a discontinuity; that is an angle, at its intersection with that of the injectors (4), and its exit section is sized so that the mixture is ejected from the nozzle at a pressure P1 of the external medium without forming a pressure wave in the divergent nozzle (5); the ejection speed of the mixture therefore corresponds to the maximum ejection speed.

The pressure diminishes during the flow of the mixture along the divergent nozzle (5), causing the temperature of the mixture to be lowered, a continuous evaporation of liquid, and a continuous attainment of speed of the vapor due to the increase in its flow; under the effect of friction with the vapor, the liquid droplets also attain speed, and the process continues up to the exit opening (6), where the pressure P1 of the mixture is in equilibrium with that of the ambient medium in which the liquid is sprayed.

Mathematical simulation of the Overheated Liquid flow along the device shows that the exit pressure of the injectors (4) is equal to the saturated vapor pressure Ps; once it has entered the divergent nozzle, the liquid flow is cooled, and instantaneously brought to a boil, and is separated into particles under the effect of vapor pressure forces inside the liquid; the size of the particles is linked to these separation forces, that themselves depend on the conductivity of the liquid, on the heat exchange and diffusion coefficients and on the slope of the generator of the divergent nozzle (5) at the junction with the injectors (4); these forces are even greater, and the particle size even smaller as this slope approaches the vertical.

In a device sized for a predefined application, the flow of sprayed liquid may be modified by modifying the pressure Po and the temperature To of the liquid upon entering the nozzle; ideally, the highest particle speed on exiting the device is obtained when this pair of values corresponds to the exit section of the divergent nozzle (5).

In order to improve the performance of the device, the generator slope of the divergent nozzle (5) may, at its limit, be vertical at its junction with the injectors (4), as shown in FIG.

1A: the divergent nozzle (5) therefore presents a flat part at its junction with (4); this flat part, creating a high pressure variation, allows very fine droplets to be obtained and facilitates the machining of the nozzle.

Figure 1B:
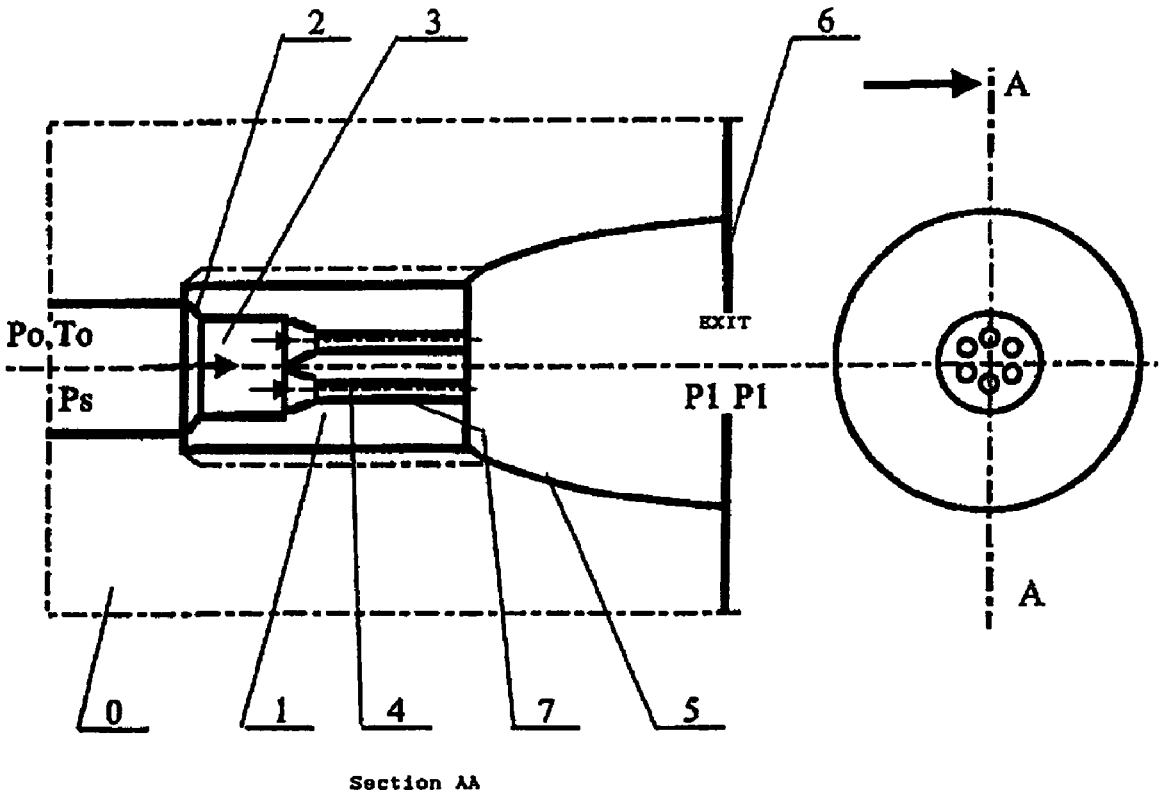

If necessary, the divergent nozzle may be partially or totally integrated with the external support (0), as shown in FIG. 1B.

By way of example of an embodiment, a spray nozzle according to FIG. 1A, comprised of a body in stainless steel with a length of 20 mm, of 9 injectors with diameters of 0.5 mm, and of a divergent nozzle with an exit diameter of 8 mm, allows 200 k/h of Overheated Water to be sprayed at 60 bar and 270° C. in ambient air, at an ejection speed neighboring 540 m/s, the size of the sprayed particles being close to 5 microns and their temperature equal to 100° C.; almost 30% of the input flow of Overheated Water is found in vapor form upon exiting the nozzle.

Variation 2

Figure 2:
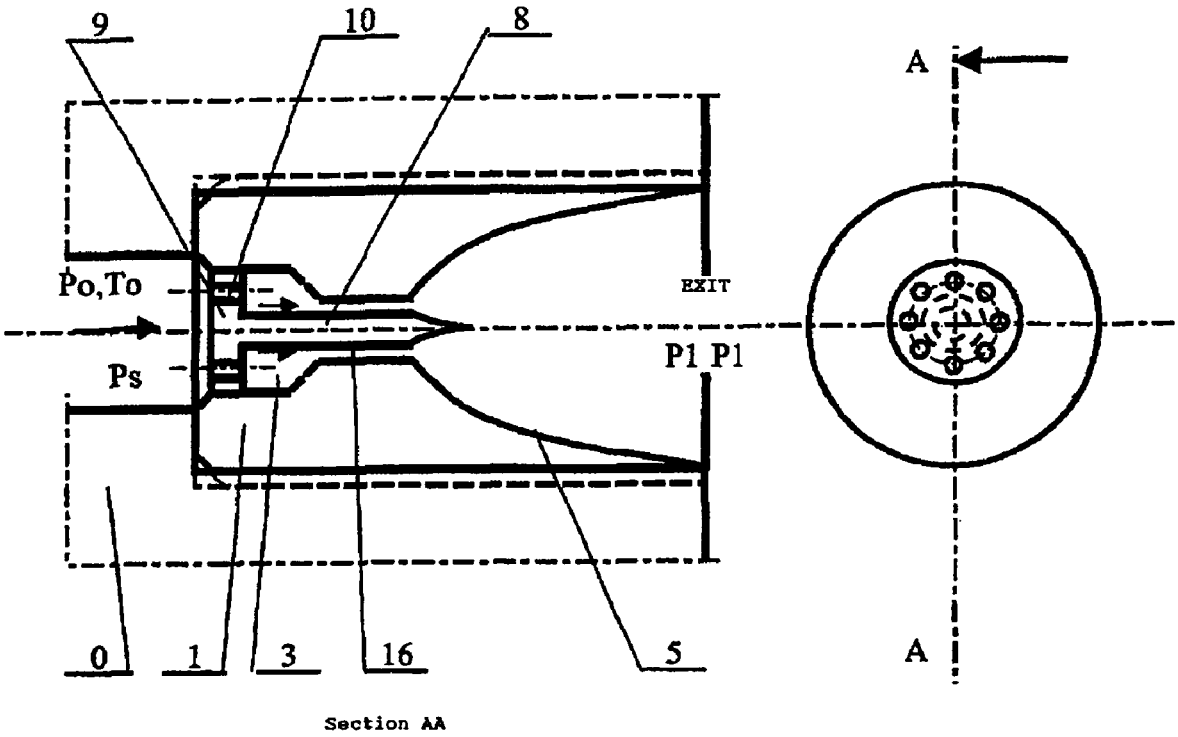
FIG. 2 is a side elevational, grossly schematic view of a nozzle body in accordance with a second embodiment of the invention.

The device shown in FIG. 2 allows the design concept of the spray nozzle to be simplified, its capacity to be increased, and its manufacturing to be facilitated by replacing the cylindrical injectors (4) with an annular injector (16).

The device according to the invention is comprised of a nozzle body (1) fixed on a support (0) allowing the supply of Overheated Liquid; the nozzle body comprises a conduit (3) where the Overheated Liquid circulates, followed by a mixer head and a section of annular passage (16) that we call the Annular Injector, where the Overheated Liquid attains speed to open onto a divergent expansion and speed attainment nozzle (5); once it has entered this nozzle, the liquid jet partially evaporates and explodes instantaneously under the effect of its own vapor pressure to comprise a mixture of fine droplets and vapor.

The generator of the divergent nozzle (5) presents a discontinuity, that is an angle, at its intersection with that of the annular injector (16), and its exit section is sized so that the mixture is ejected from the nozzle at the pressure P1 of the external medium without forming a pressure wave in the divergent nozzle (5); the ejection speed of the mixture therefore corresponds to the maximum ejection speed.

The annular injector is comprised of the free space between a cavity (16), for example cylindrical, and an injection core (8); the mode of fixation of the injection core on the nozzle body allows circulation of the liquid to be sprayed in the nozzle. By way of a non-exhaustive example, FIG. 2 shows a cylindrical injection nozzle (8) equipped with a base (9) comprising passage holes (10), the base itself being fixed to the input conduit (3).

The pressure diminishes during the flow of the mixture along the divergent nozzle (5), causing the temperature of the mixture to be lowered, a continuous evaporation of liquid, and a continuous attainment of speed of the vapor due to the increase in its flow; under the effect of friction with the vapor, the liquid droplets also attain speed, and the process continues up to the exit opening, where the pressure P1 of the mixture is in equilibrium with that of the ambient medium in which the liquid is sprayed.

Mathematical simulation of the Overheated Liquid flow along the device shows that the exit pressure of the injector (16) is equal to the saturated vapor pressure Ps; once it has entered the divergent nozzle, the liquid flow is cooled, and instantaneously brought to a boil, and is separated into particles under the effect of vapor pressure forces inside the liquid; the size of the particles is linked to these separation forces that themselves depend on the conductivity of the liquid, on the heat exchange and diffusion coefficients and on the slope of the generator of the divergent nozzle (5) at the junction with the injector (16); these forces are even greater, and the particle size even smaller as this slope approaches the vertical.

In a device sized for a predefined application, the flow of sprayed liquid may be modified by modifying the pressure Po and the temperature To of the liquid upon entering the nozzle; ideally, the highest particle speed on exiting the device is obtained when this pair of values corresponds to the exit section of the divergent nozzle (5).

In order to improve the performance of the device, the slope of the generator of the divergent nozzle (5) may, at its junction with the generator of the cavity (16), be at the perpendicular limit to the axis of this cavity, as shown in FIG. 1A: the divergent nozzle (5) therefore presents a sharp increase of the section with relation to the exit of the injector (16); this sharp increase of the section creates a high pressure variation and allows very fine droplets to be obtained; in addition, it facilitates machining of the nozzle.

If necessary, the divergent nozzle may be partially or totally integrated with the external support (0), as shown in FIG. 1B.

By way of example of an embodiment, a spray nozzle according to FIG. 2 comprised of a stainless steel body with a length of 50 mm, of an annular injector comprising a hole with a diameter of 5 mm and an injection core with a diameter of 4 mm, and a divergent nozzle with an exit diameter equal to 16 mm, allows overheated water to be sprayed at 800 k/h at 60 bar and 270° C. in ambient air, at an ejection speed neighboring 540 m/s, the size of the sprayed particles being close to 5 microns and their temperature equal to 100° C.; close to 30% of the input flow of overheated water is found in the form of vapor upon exiting the nozzle.

Variation 3

Figure 3:
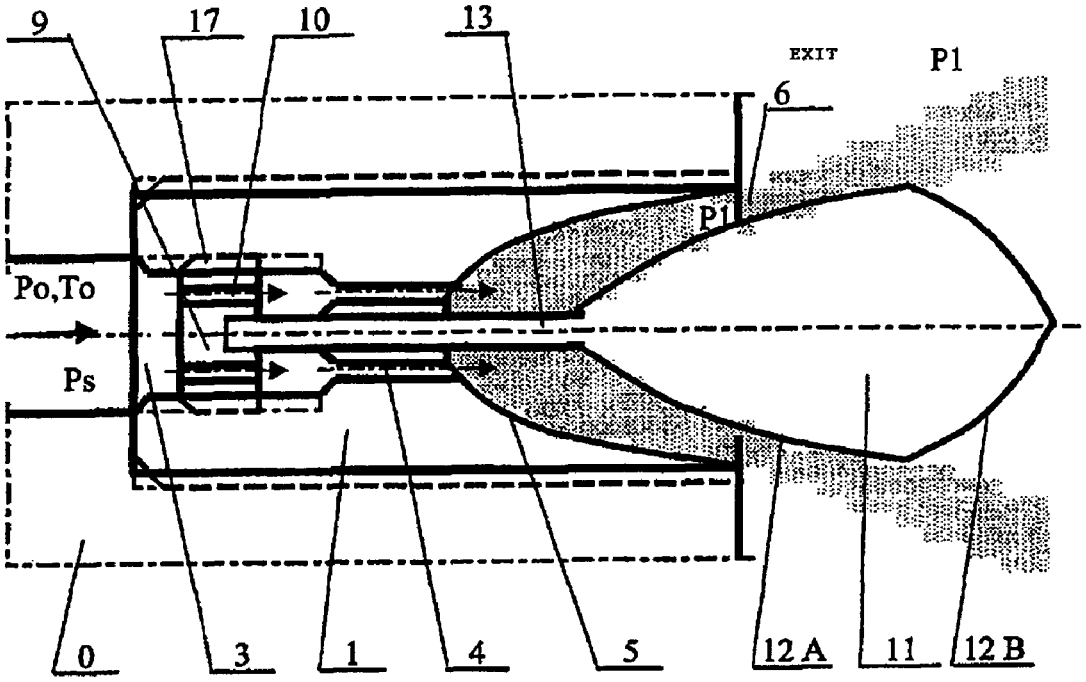
FIG. 3 is a side elevational, grossly schematic view of a nozzle body in accordance with a third embodiment of the invention.

The device represented in FIG. 3 allows, for the same spray nozzle, the flow, the Pressure Po, or the Temperature To of the Overheated Liquid on entry to be modified as required, as well as the Pressure P1 of the gaseous medium in which the liquid is sprayed, while maintaining a maximum ejection speed of droplets sprayed out of the device, this result being obtained by controlled insertion of a profiled core (11) in the divergent nozzle (5).

The device according to the invention is comprised of a nozzle (1) fixed on a support (0) allowing supply of Overheated Liquid; the nozzle body comprising a conduit (3) where the Overheated Liquid circulates, followed by a mixer head and one or more injectors (4) where the Overheated Liquid attains speed to open onto a divergent expansion and speed attainment nozzle (5); once entered in this nozzle, the liquid jet partially evaporates and instantaneously explodes under the effect of its own vapor pressure to comprise a mixture of fine droplets and vapor.

A profiled core (11) may slide on the axis of the divergent nozzle (5), and allows, depending on its position, the exit section of this nozzle to be adjusted; the continuous and monotonic profiles of the generators of the divergent nozzle (5) and of the core (11) allow a section of increasing passage between (5) and (11) to be maintained along the axis of the nozzle, whatever the position of the core (11); by way of a non-exhaustive example, the profiles of generators corresponding to variations in linear or parabolic sections allow this requirement to be met.

The form of the downstream generator (12B) of the core (11) is irrelevant, and may either be flat, that is, comprised of a flat base, or have an aerodynamic profile to limit the pressure loss of the mixture after its exit from the spray nozzle, or be adapted to other constraints from the nozzle environment.

The generator of the divergent nozzle (5) presents a discontinuity, that is an angle, at its intersection with that of the injectors (4).

The core (11) is supported by a mechanism allowing its relative position to be adjusted with relation to the nozzle (5); this mechanism may be incorporated either to the nozzle or externally; the non-exhaustive example of FIG. 3 shows a core supported by an axis (13) crossing the spray nozzle, and comprising at its extremity a base (9) equipped with holes (10) allowing the passage of liquid to be sprayed; a threading (17) on this base and on the conduit (3) allows the relative positions of the core and the nozzle to be adjusted.

The exit section of the nozzle may be adjusted so that the mixture is ejected from the nozzle at the pressure P1 without forming a pressure wave in the divergent nozzle (5) whatever the flow of the liquid to be sprayed, whatever its pressure Po and temperature To, and whatever the pressure P1 of the gaseous medium in which the liquid is sprayed; the ejection speed of the mixture then corresponds to the maximum ejection speed.

The pressure diminishes during the flow of the mixture along the divergent nozzle (5), causing the temperature of the mixture to be lowered, a continuous evaporation of liquid, and a continuous speed attainment of the vapor due to the increase in its flow; under the effect of friction with the vapor, the liquid droplets also attain speed, and the process continues up to the exit opening, where the pressure P1 of the mixture is in equilibrium with that of the ambient medium in which the liquid is sprayed.

Mathematical simulation of the Overheated Liquid flow along the device shows that the exit pressure of the injector (16) is equal to the saturated vapor pressure Ps; once it has entered the divergent nozzle, the liquid flow is cooled, and instantaneously brought to a boil, and is separated into particles under the effect of vapor pressure forces inside the liquid; the size of the particles is linked to these separation forces that themselves depend on the conductivity of the liquid, on the heat exchange and diffusion coefficients and on the slope of the generator of the divergent nozzle (5) at the junction with the injector (16); these forces are even greater, and the particle size even smaller as this slope approaches the vertical.

In a device sized for a predefined application, the flow of sprayed liquid may be modified by modifying the pressure Po and the temperature To of the liquid upon entering the nozzle.

In order to improve the performance of the device, the slope of the generator of the divergent nozzle (5) may, at its junction with the generator of the cavity (16), be at the perpendicular limit to the axis of this cavity, as shown in FIG. 3: the divergent nozzle (5) therefore presents a sharp increase of the section with relation to the exit of the injector (16); this sharp increase of the section creates a high pressure variation and allows very fine droplets to be obtained; in addition, it facilitates machining of the nozzle.

If necessary, the divergent nozzle may be partially or totally integrated with the external support (0), as shown in FIG. 1B.

By way of example of an embodiment, a spray nozzle according to FIG. 3, comprised of a stainless steel body with a length of 80 mm, of 9 injectors with a diameter of 0.5 mm and a divergent nozzle with an exit diameter equal to 23 mm, and a core with a maximum diameter of 80 mm, allows overheated water to be sprayed at 200 k/h at 60 bar and 270° C. in air whose pressure P1 varies from ambient pressure to 0.1 bar A, the extreme conditions for ejection being:

for air at ambient pressure: an ejection speed neighboring 540 m/s, and a sprayed particle size approaching 5 microns at a temperature equal to 100° C.; close to 30% of the input flow of overheated water is found in the form of vapor upon exiting the nozzle.

for air at a pressure of 0.1 bar A: an ejection speed neighboring 700 m/s and a sprayed particle size approaching 5 microns at a temperature equal to 46° C.; close to 31% of the input flow of overheated water is found in the form of vapor upon exiting the nozzle.

Variation 4

Figure 4:
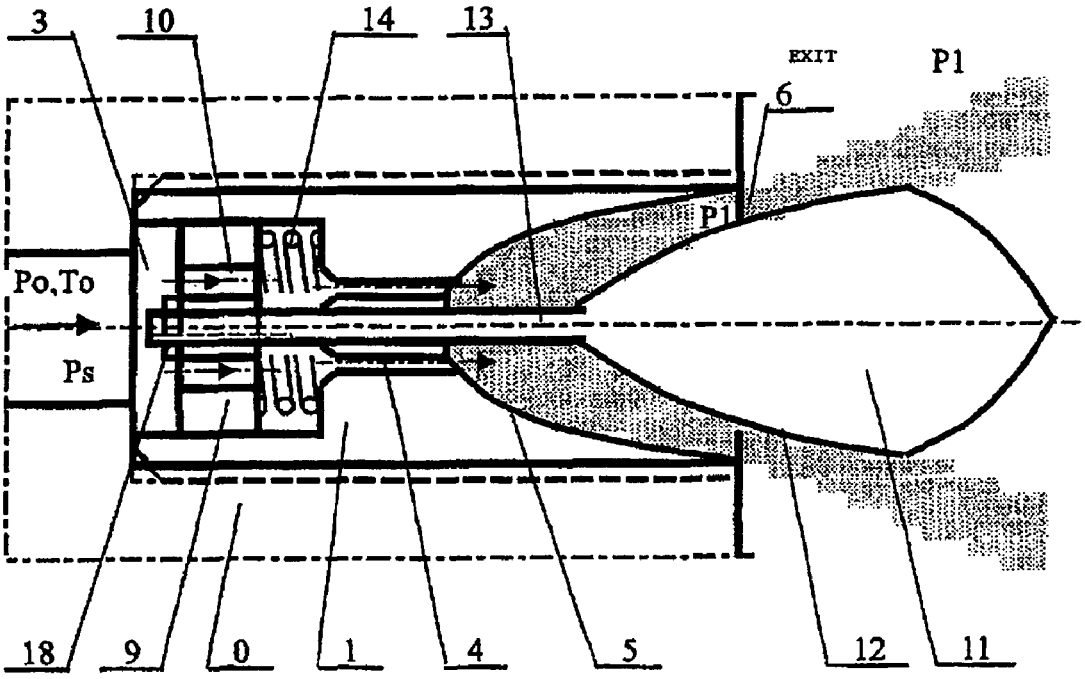
FIG. 4 is a side elevational, grossly schematic view of a nozzle body in accordance with a fourth embodiment of the invention.

The device represented in FIG. 4 allows the operation of variation 3 to be improved by automating the positioning of the core (11) in the divergent nozzle (5).

The automation system acts on the support mechanism and the positioning of the core (11) so that the exit section of the nozzle corresponds to the flow, Pressure Po, and Temperature To of the overheated water upon entry, as well as to the Pressure P1 of the gaseous medium in which liquid is sprayed, so that the ejection speed of the sprayed droplets exiting the device is maximum; it may be incorporated either to the spray nozzle or externally.

The non-exhaustive example of FIG. 4 represents a device equipped with an automation system incorporated in the spray nozzle; the elements that comprise the system are identical to those of FIG. 3, except that the threading (18) of the flat part (9) forming an integral part of the core is removed to be replaced by a return spring (14) that tends to penetrate the core (11) in the divergent nozzle (5); a threading and a screw (18) allowing the tension of the return spring (11) to be adjusted.

During operation of the nozzle, the core (11) is subject to force from the spring (11) that tends to introduce the core in the nozzle (5), and to the static and dynamic pressure forces of the mixture flux. The latter are directly linked to the flow and to the Temperature To of the overheated water upon entering the nozzle, to the Pressure P1 upon exiting, and to the exit slopes of the generators of (5) and of (11); they tend to extract the core (11) from the divergent nozzle (5).

These opposed forces are equivalent for a given position of the core; this position may be adjusted by the screw (18) during a given operation case so that the mixture is ejected from the nozzle at the exit pressure P1 without forming a pressure wave in the divergent nozzle (5): the ejection speed of the mixture therefore corresponds to the maximum ejection speed.

The rigidity of the return spring (11) and of the exit slope of the nozzle (5) are defined so that these optimum ejection conditions are obtained for all other cases of operation of the nozzle without it being necessary to readjust the screw (18).

By way of example of an embodiment, a spray nozzle according to FIG. 4, comprised of the same elements as those of the example of variation 3 but including the system for automating the position of the core (11) such as defined above, leads to the same performance without it being necessary to intervene when the flow of the nozzle varies or when the pressure of the gaseous medium in which the liquid is sprayed varies.

Variation 5

Figure 5:
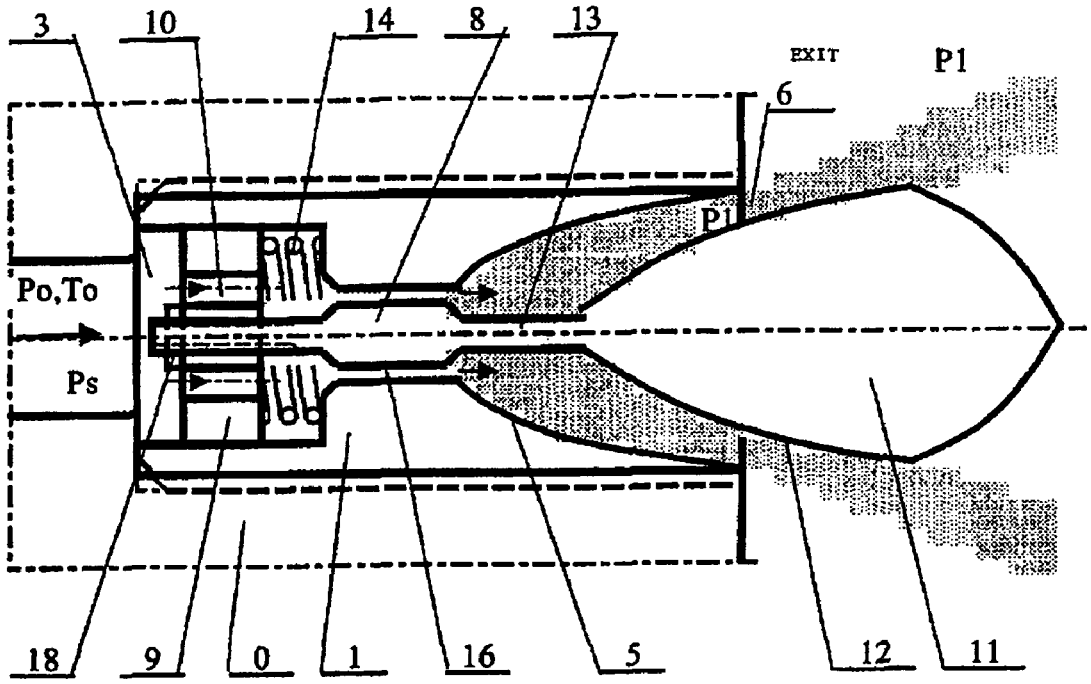
FIG. 5 is a side elevational, grossly schematic view of a nozzle body in accordance with a fifth embodiment of the invention.

The device represented in FIG. 5 allows variations 3 and 4 to be improved in order to increase their capacity and to facilitate fabrication by replacing the cylindrical injectors (4) with an annular injector (16).

The annular injector is comprised of the free space between a cavity (16), cylindrical for example, and an injection core (8); the mode of fixation of the injection core on the nozzle body allows the liquid to be sprayed to circulate in the nozzle. The non-exhaustive example of FIG. 5 represents a cylindrical injection core (8) equipped with a base (9) comprising passage holes (10) allowing circulation of the liquid to be sprayed.

By way of example of an embodiment, a spray nozzle according to FIG. 5, comprised of a stainless steel body with a length of 50 mm, of an annular injector comprising a hole with a diameter of 5 mm and a core with a diameter of 4 mm, and of a divergent nozzle with an exit diameter equal to 16 mm, allows Overheated Water to be sprayed at 800 k/h at 60 bar and 270° C. in air In air whose pressure P1 varies from 1 bar A to 0.1 bar A, the extreme ejection conditions being:

for air at 1 bar A: an ejection speed approaching 540 m/s, and a size of sprayed particles approaching 5 microns at a temperature equal to 100° C.; nearly 30% of the input flow of the overheated water is found in the form of vapor upon exiting the nozzle.

For air at a pressure of 0.1 bar A: an ejection speed approaching 700 m/s, and a size of sprayed particles approaching 5 microns at a temperature equal to 46° C.; close to 31% of the input flow of overheated water is found in the form of vapor upon exiting the nozzle.

Variation 6

Figure 6:
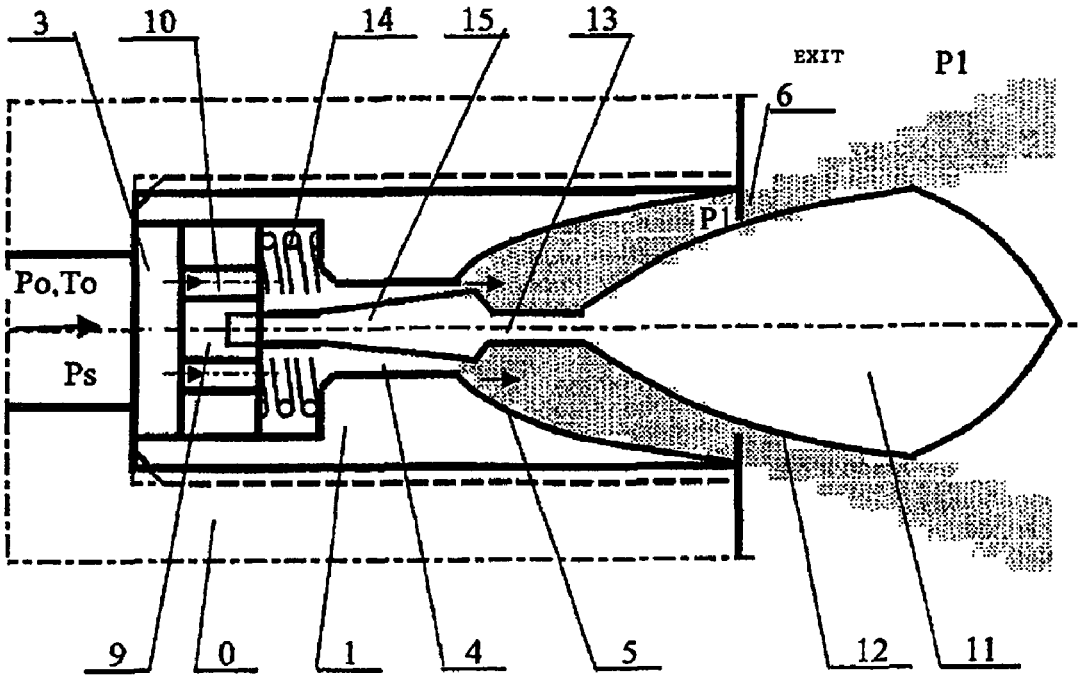
FIG. 6 is a side elevational, grossly schematic view of a nozzle body in accordance with a sixth embodiment of the invention.

The device represented in FIG. 6, allowing variations 2 and 5 to be improved to increase their flexible use by replacing the injection core (8) of the annular injector with a profiled injection core (15) of variable section increasing in the direction of flow that may slide on the axis of the cavity (4), the exit section of the injector may then be adjusted by adjusting the position of the profiled injection core (15) with relation to the cavity (4).

Figure 7:
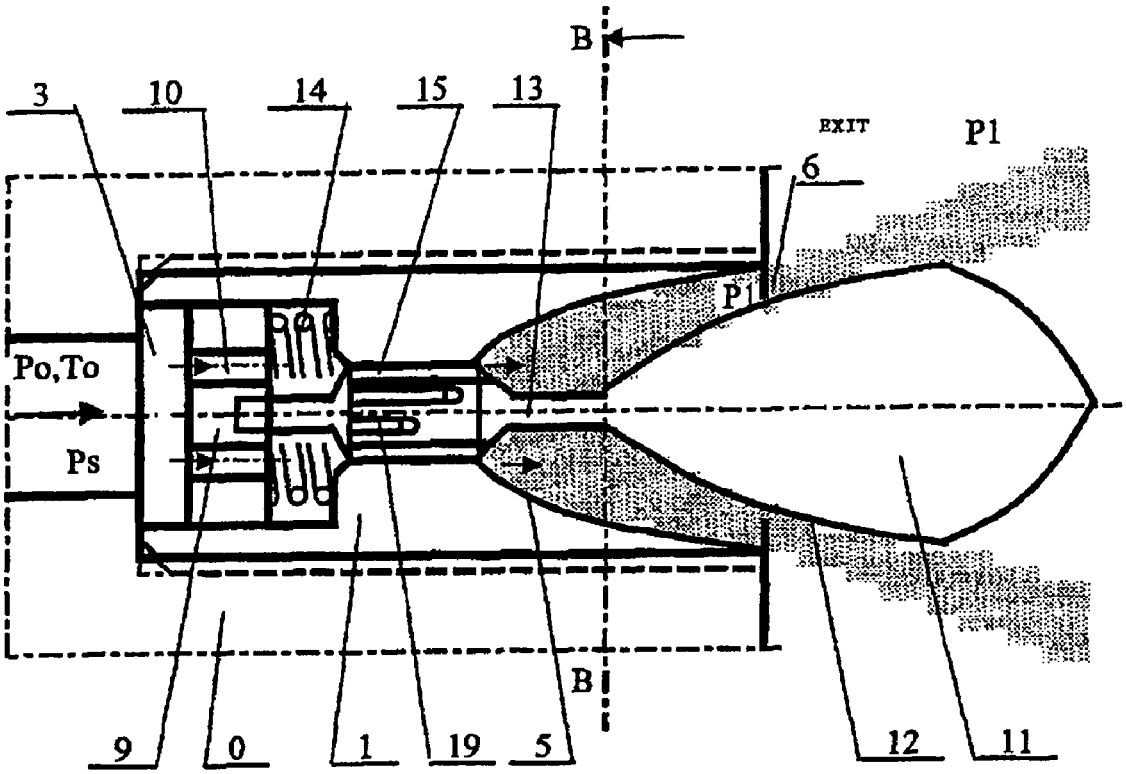
Figure 7:
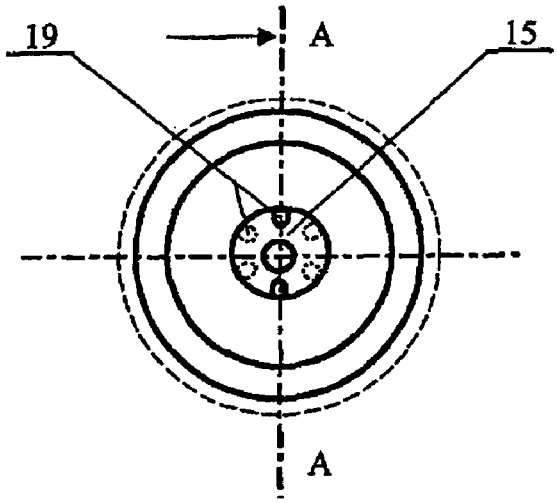

The non-exhaustive example of FIG. 6 represents a conical profiled injection core (15). The non-exhaustive example of FIG. 7 represents a cylindrical profiled injection core (15) equipped with external semi-cylindrical recesses (19) parallel to the axis of (15), of different lengths, each comprising a passage section for the liquid to be sprayed; the number of recesses (19) opening onto the nozzle (5), and therefore the passage section of the injector, are directly linked to the position of the core (11) in the nozzle (5).

By way of an example of an embodiment, a spray nozzle according to FIG. 6, with dimensions identical to that of the embodiment example of variation 5 and comprising a conical profiled injection core with extreme diameters 4 mm and 5 mm, presents the same performance as that of variation 5, but the flow of sprayed water may be adjusted from 100 to 800 kg/h.

INDUSTRIAL APPLICATIONS OF THE INVENTION

The device according to the invention finds its applications in the following industrial processes:

Chemical processes necessitating the very rapid cooling of industrial gas,

Chemical and agriculture and food system processes necessitating the use of sprayed liquids in the form of very small-size particles, Processes necessitating the use of liquids sprayed at very high speeds: test facilities, energy facilities, thermokinetic compressors, etc.

The invention claimed is:

1. A device designed to spray an overheated liquid in the form of very fine droplets at a very high speed, the overheated liquid having a temperature To and a pressure Po greater than a saturated vapor pressure Ps corresponding to To, the vapor pressure Ps greater than a pressure P1 of a gaseous medium in which the liquid is sprayed, comprising a nozzle body fixed on a support and receiving a supply of the overheated liquid, the nozzle body comprising a conduit where the overheated liquid circulates, followed by one or more convergent heads and by one or more injectors where the overheated liquid attains speed to open onto a divergent and speed attainment nozzle where a liquid jet of the overheated liquid partially evaporates and instantaneously explodes under effect of a pressure difference between the liquid and an ambient medium of the divergent nozzle to form a mixture of fine droplets and vapor, wherein a generatrix of the divergent nozzle presents a discontinuity in the form of an angle at an intersection with the one or more injectors, and an exit section of the divergent nozzle is sized such that the mixture is ejected from the divergent nozzle at the pressure P1 of the gaseous medium at maximum ejection speed.

2. The device according to claim 1, wherein the angle between the generatrix of the divergent nozzle and walls of the one or more injectors is a right angle at an output of the one or more injectors.

3. The device according to claim 1, wherein the divergent nozzle is at least partially integrated with the support.

4. A device designed to spray an overheated liquid in very fine droplets at a very high speed, the overheated liquid having a temperature To and a pressure Po greater than a saturated vapor pressure Ps corresponding to To, the vapor pressure Ps greater than a pressure P1 of a gaseous medium in which the liquid is sprayed, comprising:

a nozzle body fixed on a support and receiving a supply of the overheated liquid, the nozzle body comprising a conduit where the overheated liquid circulates, followed by a convergent head and an annular injector passage section where the overheated liquid attains speed to open into a divergent and speed attainment nozzle where a liquid jet partially evaporates and instantaneously explodes under effect of a pressure difference between the liquid and an ambient medium of the nozzle to form a mixture of fine droplets and vapor, wherein a generatrix of the divergent nozzle presents a discontinuity in the form of an angle at an intersection with the annular injector passage section, and an exit section of the divergent nozzle is sized such that the mixture is ejected from the divergent nozzle at the pressure P1 of the gaseous medium at maximum ejection speed.

5. The device according to claim 4, wherein the annular injector passage section comprises a free space between a cavity and an injection core, and wherein a mode of fixation of the injection core on the nozzle body allows circulation of the liquid to be sprayed in the divergent nozzle.

6. The device according to claim 5, wherein the injection core of the annular injector passage section is a profiled injection core of variable section increasing in the direction of flow adapted to slide on an axis of the annular injector passage section, and wherein an exit section of the annular injector passage section is adapted to be adjusted by adjusting a position of the profiled injection core.

7. The device according to claim 4, wherein the generatrix of the divergent nozzle is perpendicular to walls of a cavity of the annular injector passage section.

8. The device according to claim 4, wherein the divergent nozzle is at least partially integrated with the support.

9. A device designed to spray an overheated liquid in the form of very fine droplets at a very high speed and allowing a flow, a pressure Po or a temperature To of the overheated liquid upon entry to a spray nozzle, as well as a pressure P1 of a gaseous medium in which the liquid is sprayed, to be modified as required while maintaining a maximum ejection speed of sprayed droplets exiting the device, the overheated liquid being a liquid at a temperature To and a pressure Po greater than a saturated vapor pressure Ps corresponding to temperature To, the vapor pressure Ps being greater than the pressure P1 of the gaseous medium in which the liquid is sprayed, comprising:

a nozzle body fixed on a support and receiving a supply of overheated liquid, the nozzle body comprising a conduit where the overheated liquid circulates, followed by one or more convergent heads and by one or more injectors where the overheated liquid attains speed to open into a divergent and speed attainment nozzle where a liquid jet of the overheated liquid partially evaporates and instantaneously explodes under effect of a pressure difference between the liquid and the divergent nozzle to form a mixture of fine droplets and vapor, wherein a profiled core is housed in the divergent nozzle and is configured to slide on an axis of the divergent nozzle to provide, according to a position of the profiled core, adjustment of an exit section of the divergent nozzle, wherein continuous and monotonic profiles of generatrixes of the divergent nozzle and of the profiled core provide for an increasing passage section between the divergent nozzle and the profiled core along the axis of the divergent nozzle to be maintained, regardless of the position of the profiled core, wherein a generatrix of the divergent nozzle presents a discontinuity in the form of an angle at an intersection with the one or more injectors, and wherein a mechanism provides for the profiled core to be supported and a relative position of the profiled core relative to the divergent nozzle to be adjusted externally.

10. The device according to claim 9, wherein the generatrix of the divergent nozzle is perpendicular to walls of the one or more injectors at an output of the one or more injectors.

11. The device according to claim 9, wherein the divergent nozzle is at least partially integrated with the support.

12. The device according to claim 9, wherein positioning of the profiled core in the divergent nozzle comprises automation designed to adjust the exit section of the divergent nozzle such that the exit section corresponds to the flow, pressure Po, and temperature To of the overheated liquid upon entry, as well as to the pressure P1 of the gaseous medium in which the liquid is sprayed, to maximize the ejection speed of the sprayed droplets exiting from the device.

13. The device according to claim 12, wherein the one or more injectors are annular injectors, the annular injectors comprising free space between a cavity and an injection core.

14. The device according to claim 13, wherein the injection core of the annular injector is a profiled injection core of variable section increasing in a direction of flow and adapted to slide on an axis of the annular injector such that an exit section of the annular injector may then be adjusted by adjusting a position of the profiled injection core.

15. The device according to claim 9, wherein the one or more injectors are annular injectors, the annular injectors comprising free space between a cavity and an injection core.

16. The device according to claim 15, wherein the injection core of the annular injector is a profiled injection core with a variable section increasing in the direction of flow and configured to slide on an axis of the annular injector, such that an exit section of the annular injector is adjustable by adjusting a position of the profiled injection core.

* * * * *